United States Patent [19]

Manley et al.

[11] Patent Number: 5,048,837

[45] Date of Patent: Sep. 17, 1991

[54] GOLF CLUB SWING TRAINING BRACE

[75] Inventors: Michael P. Manley, 1090 Oakwood, Ortonville, Mich. 48426; James J. Manley, 17671 Barry, Mt. Clemens, Mich. 48044; Brian K. Blackburn, Rochester, Mich.; Scott B. Gentry, Shelby, Mich.; Joseph F. Mazur, Washington, all of Mich.

[73] Assignees: Michael Manley, Ortonville; James Manley, Mt. Clemens, Mich.

[21] Appl. No.: 636,508

[22] Filed: Dec. 31, 1990

[51] Int. Cl.[5] ..... A63B 69/36

[52] U.S. Cl. ..... 273/183; 273/189 A

[58] Field of Search ..... 273/183 B, 189 R, 189 A, 273/188 R, 190 R, 54 B

[56] References Cited

U.S. PATENT DOCUMENTS

| | | | |
|---|---|---|---|
| 3,339,926 | 9/1967 | Coupar | 273/183 B |
| 3,419,277 | 12/1968 | Martin | 273/189 R |
| 4,575,089 | 3/1986 | Corbett et al. | 273/183 B |

FOREIGN PATENT DOCUMENTS

| | | | |
|---|---|---|---|
| 2166959 | 5/1986 | United Kingdom | 273/189 A |

*Primary Examiner*—George J. Marlo
*Attorney, Agent, or Firm*—Peter D. Keefe

[57] ABSTRACT

A golf swing brace which regulates elbow flexing in a manner which is responsive to the golfer's swing so that elbow flexing is prevented before and during golf ball addressment, but is freely permitted thereafter, thus truly simulating for the golfer-in-training proper swing technique. The golf swing brace consists of an upper arm brace and a forearm brace, each mutually pivotally connected together at a pivot. Arm bands attach the upper arm and forearm braces to the respective portions of the golfer's lead arm (left arm in the case of a right-handed golfer). The upper arm and forearm braces are oriented so that the pivot is axially in line with the golfer's elbow. Thus, if the pivot is locked, the golfer cannot bend his or her lead arm at the elbow, but if the pivot is not locked, the golfer is able to freely bend his or her lead arm at the elbow. The pivot is selectively lockable, with selective locking of the pivot being accomplished by movement of a stop pin with respect to an abutment, where the stop pin is connected with the forearm brace and the abutment is connected with the upper arm brace. A sensor and actuator cooperate to move the stop pin at an appropriate juncture so that the golfer may simulate a "professional" swing in which the elbow cannot bend until the ball has been addressed, and is then able to freely bend thereafter.

20 Claims, 3 Drawing Sheets

GOLF CLUB SWING TRAINING BRACE

BACKGROUND OF THE INVENTION

1. Field of the Invention

The present invention relates to aids for sports training, and more particularly to a training brace for a golfer to learn proper golf club swing technique. Still more particularly the present invention relates to a brace for the arm of a golfer which teaches the golfer proper golf club swing technique by imposing selective control over movement of the golfer's arm at the elbow during swing.

2. Description of the Prior Art

Many people enjoy the sport of golf for its relaxing out-of-doors qualities. Each of these people dream of perfecting their game. One of the critical factors that determines game performance is golf club swing (hereinafter referred to simply as "swing"). This is because the quality of the swing determines the distance and direction that the golf ball will take upon being addressed (that is, struck) by the club. Standards of swing technique are now well established, which, if followed, would improve the game of many players. In the art of golf, the standard swing is one in which the leading arm (the left arm in the case of right-hand players) remains straight until contact with the golf ball has been made by the club, thereafter the lead arm flexes at the elbow as the swing carries forward under the generated momentum of the swing.

Unfortunately, this swing technique is not easily learned. Swing technique must be both understood and practiced by the player before mastery is achieved. Unfortunately, many golf enthusiasts are not gifted with an ability to easily and quickly master swing technique. These people must either spend a great amount of time in practice, or simply ignore their inadequacy and play the game with an admitted "sloppy" swing. Yet, proper swing can be learned by any golfer, given the right environment to learn.

In the prior art, C. B. Martin in U.S. Pat. No. 3,419,277, dated Dec. 31, 1968, addressed the issue of perfecting swing technique by the utilization of a golfer's brace. Martin proposed a brace having a torso component and an arm component, the arm component being a length adjustable elongate structure adapted to engage primarily the upper arm of the golfer via an arm band. The arm component is hingably connected with the torso component allowing two degrees of freedom of movement. Stops on the torso component regulate possible movement of the arm component in order to place the golfer's arm in a best angle for optimally addressing the golf ball with the club. Martin also addresses the issue of the lead arm of the golfer remaining straight before and during address of the golf ball. Martin indicates that this is achieved by the arm band sliding along the golfer's arm. When the golfer begins his or her swing, the arm band will have slid along the golfer's arm to a position encircling the elbow, thereby preventing flexing of the golfer's leading arm. But, when address of the ball has been accomplished, the arm band will have slid to a position just above the elbow, now permitting the golfer's arm to flex.

Martin's device suffers from a cumbersome structure that is not well suited to its aim. This is primarily because the arm component remains permanently rigid so that control of elbow flexing must be accommodated by slidable movement of an arm band with respect to the elbow. Under normal conditions the arm band must snuggly fit about the upper arm of the golfer, in which case the arm band cannot be expected to easily slide along the arm, resulting in impaired swing movement. Further, the arm band cannot be expected to truly prevent flexing at the elbow, as the mechanical forces generated by the muscles of the golfer require a brace having a far larger lever arm to overcome than that which the width of the arm band would provide. Still further, the arm band would not be expected to provide a mechanically rigid structure that would truly prevent flexing at the elbow. Still Further, Martin's drawing depicts a device in which a portion of the arm component extends beyond the elbow at all times, a feature sure to impede arm flexing even when permitted. Therefore, while Martin may sincerely wish to address the issue of elbow flexing of the golfer's arm before and during golf ball addressment, Martin's solution is not sufficiently practical to afford a true solution to the issue.

Accordingly, what is needed is a golf swing brace which regulates elbow flexing in a manner which is responsive to the golfer's swing so that elbow flexing is prevented before and during golf ball addressment, but is freely permitted thereafter, thus truly simulating for the golfer-in-training proper swing technique.

SUMMARY OF THE INVENTION

The present invention is a golf swing brace which regulates elbow flexing in a manner which is responsive to the golfer's swing so that elbow flexing is prevented before and during golf ball addressment, but is freely permitted therafter, thus truly simulating for the golfer-in-training proper swing technique.

The present invention is composed of a two-part arm brace consisting of an upper arm brace and a forearm brace. The upper arm and forearm braces are mutually connected by a pivot. Arm bands attach the upper arm and forearm braces to the respective portions of the golfer's lead arm (left arm in the case of a right-handed golfer). The upper arm and forearm braces are oriented so that the pivot is axially in line with the golfer's elbow. Thus, if the pivot is locked, the golfer cannot bend his or her lead arm at the elbow, but if the pivot is not locked, the golfer is able to freely bend his or her lead arm at the elbow. The pivot is selectively lockable, with selective locking of the pivot being accomplished by movement of a stop pin with respect to an abutment, where the stop pin is connected with the forearm brace and the abutment is connected with the upper arm brace. A sensor and actuator cooperate to move the stop pin at an appropriate juncture so that the golfer may simulate a "professional" swing in which the elbow cannot bend until the ball has been addressed, and is then able to freely bend thereafter.

Accordingly, it is an object of the present invention to provide a golf swing brace which effectively and truly simulates for a golfer-in-training a professional golf swing.

It is another object of the present invention to provide a golf swing brace which has two mutually pivotable brace components, one attaching to the golfer's upper arm, and the other attaching to the golfer's forearm, selected pivotable movement between the two brace components controlling the golfer's ability to bend his or her arm at the elbow.

It is yet another object of the present invention to provide a golf swing brace which has two mutually pivotable brace components, one attaching to the golfer's upper arm, and the other attaching to the golfer's forearm, selected pivotable movement between the two brace components controlling the golfer's ability to bend his or her arm at the elbow, selection of pivotability being regulated by sensing of at least one physical parameter associated with the golf swing.

It is a further object of the present invention to provide a golf swing brace which has two mutually pivotable brace components, one attaching to the golfer's upper arm, and the other attaching to the golfer's forearm, selected pivotable movement between the two brace components controlling the golfer's ability to bend his or her arm at the elbow, selection of pivotability being determined by the generation of predetermined inertial forces during the swing.

It is yet a further object of the present invention to provide a golf swing brace which has two mutually pivotable brace components, one attaching to the golfer's upper arm, and the other attaching to the golfer's forearm, selected pivotable movement between the two brace components controlling the golfer's ability to bend his or her arm at the elbow, pivotability being determined by interaction between a selectively movable stop pin and an abutment, the stop pin being connected to one of the two brace components, and the abutment being connected to the other of the two brace components.

These, and additional objects, advantages, features and benefits of the present invention will become apparent from the following specification.

DETAILED DESCRIPTION OF THE PREFERRED EMBODIMENT

Figure 1:
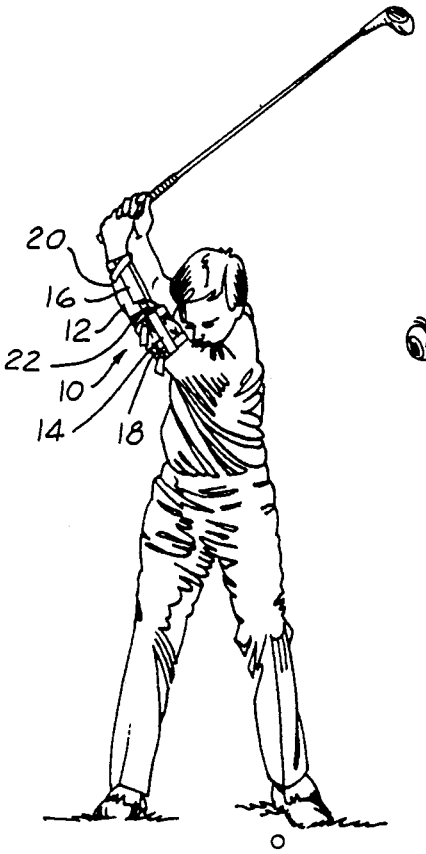
FIGS. 1 through 4 are perspective views showing the golf swing brace according to the present invention in operation.
Figure 2:
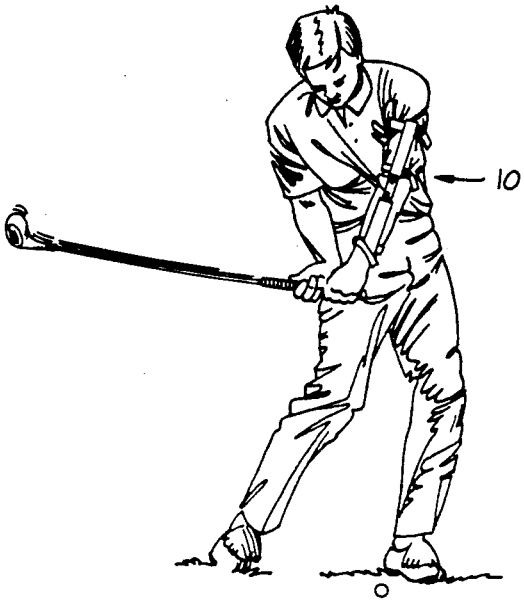
Figure 3:
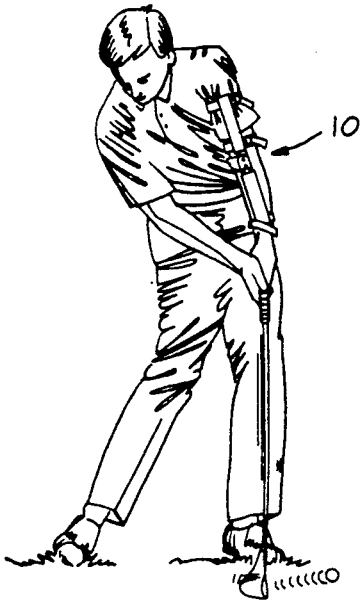
Figure 4:
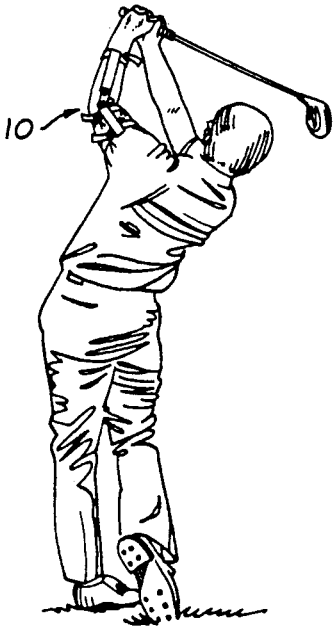

Referring now to the Drawing, FIGS. 1 through 4 show the golf swing brace 10 according to the present invention. It will be seen that the golf swing brace 10 is worn by the golfer on his or her lead arm 12 (the left arm in the case of right-handed golfers, and the right arm in the case of left-handed golfers). It will be further seen that the golf swing brace 10 has two brace components, each of elongate shape: an upper arm brace component 14 being secured to the upper arm 18 of the golfer and a forearm brace component 16 being secured to the forearm 20 of the golfer; a pivot 22 provides pivotable connection between the upper arm and forearm brace components 12, 14. It will still further be seen that the golf swing brace 10 is worn by the golfer so that the pivot is axially aligned with the golfer's elbow. Selective pivotability of the pivot controls the ability of the golfer to bend his or her elbow, thus simulating a professional golf swing. The specific structure for carrying-out this feature shall be disclosed in detail hereinbelow.

Figure 5:
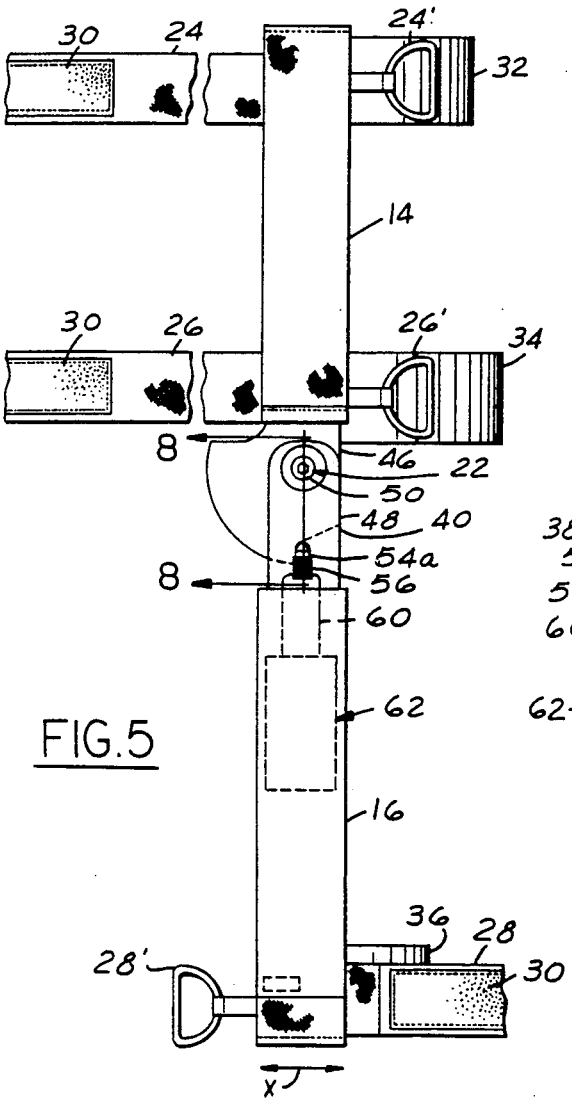
FIG. 5 is a partly broken-away plan view of the golf swing brace according to the present invention.
Figure 6:
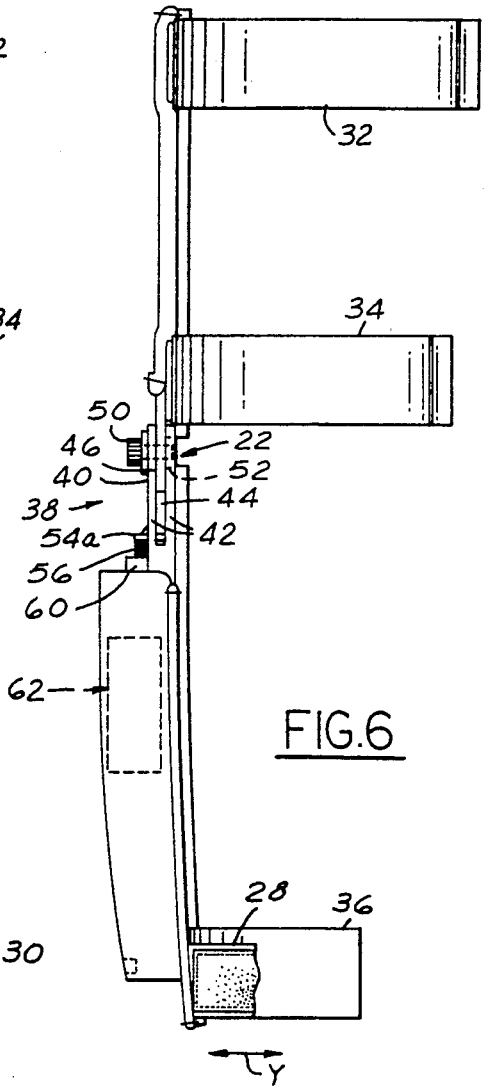
FIG. 6 is a side view of the golf swing brace according to the present invention.

Referring now to FIGS. 5 and 6, the general structural features of the preferred embodiment of the golf swing brace 10 will be detailed. As indicated, the golf swing brace 10 is composed of two elongate brace components: an upper arm brace component 14 and a forearm brace component 16 that are mutually pivotably connected by a pivot 22. It is preferred that each of the brace components be of a flat, elongate shape, and further each of the brace components is preferred to be constructed of an inflexible material, preferably aluminum or plastic. More specifically, it is desired to provide inflexibility along the X axis; some flexibility being tolerable along the Y axis. The preferred dimension of each of the brace components and the preferred construction of the pivot will become clear from the description as further presented hereinbelow.

A plurality of flexible arm bands are connected to the brace components 14, 16 for the purpose of releaseably securing the upper brace component 14 to the golfer's upper arm, and the forearm brace component 16 to the golfer's forearm. It is preferred in this regard to provide two arm bands 24, 26 for the upper arm brace component 14 and one arm band 28 for the forearm brace component 16. It is preferred to include rings 24', 26' and 28' through which the arm bands are respectively looped after wrapping about the golfer's arm (as shown in FIGS. 1 through 4), then pulled tight and secured back on itself using, preferably, a hook and loop fastener 30. Proper operation of the golf swing brace 10 requires that the pivot 22 be axially aligned with the golfer's elbow. Accordingly, in order that the golf swing brace 10 does not shift from this position, the position as shown in FIGS. 1 through 4, and further so that the upper arm brace 14 remains oriented parallel with respect to the golfer's upper arm and so that the forearm brace remains oriented parallel with respect to the golfer's forearm, the orientations as shown in FIGS. 1 through 4, it is preferred to provide a rigid arm cradle 32, 34, and 36, respectively, at each of the flexible arm bands. Preferably each arm cradle is constructed of an inflexible material, such as aluminum or plastic, and each is rigidly connected to its respective brace component. The arm cradles are preferred to have a general U-shape so that the arm of the golfer can be easily received into the arm cradles and be wrapped thereby in excess of 90 degrees. When the arm bands 24, 26 and 28 are tightened, each overlies a respective arm cradle 32, 34 and 36, so that the arm cradle is snuggly in contact with the golfer's arm. Accordingly, it will be understood that the combination of the arm bands and the arm cradles secure the golf swing brace 10 parallel to the lead arm of the golfer and further ensure that the pivot 22 remains always axially aligned with the golfer's elbow so that for the golfer to bend his or her arm, he or she must pivot the brace components 14, 16 at the pivot 22. While a preferred attachment structure has been recited herein, this is by way of example. Thus, those skilled in the art will recognize that other structures are possible which will serve the functions herein described of securing the golf swing brace 10 to the golfer's lead arm, and any such structure is contemplated to fall within the scope of the present invention.

As indicated above, the primary goal of the present invention is to provide a training brace for golfers who need to improve their swing technique, particularly as this relates to keeping their lead arm straight during the swing until the ball has been addressed by the golf club. Accordingly, the pivot 22 is equipped with a pivot control system 38 which effects to lock the pivot from being pivotable until the golf ball has been addressed, thereby holding the arm of the golfer straight, and thereafter effects to unlock the pivot to be freely pivotable, and thereby permitting the arm of the golfer to bend at the elbow during follow-through of the swing. With respect to the ability of the golf swing brace 10 to effectively control bending of a golfer's arm at the elbow, the dimensions of the brace components is such that the upper arm brace component 14 extends a first predetermined length along the upper arm of a typical golfer, while the forearm brace component 16 extends a second predetermined length along the forearm of a typical golfer. These predetermined lengths are based upon lengths sufficient to provide enough mechanical advantage at the arm bands to effectively regulate bending of the golfer's arm when the pivot 22 is locked by the pivot control system 38. These lengths have relation to the anatomy of the golfer's arm as shown in FIGS. 1 through 4.

Figure 7:
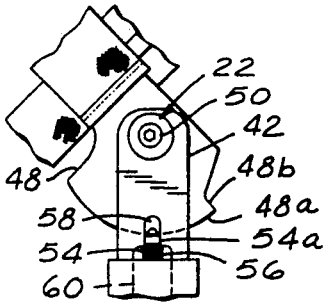
FIG. 7 is a detail side view of the pivot and the pivot control members according to the present invention.
Figure 8:
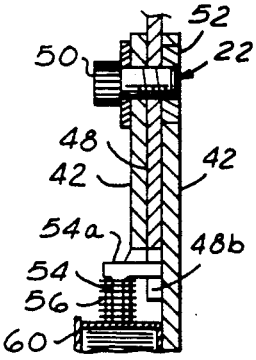
FIG. 8 is a detail partly sectional end view along lines 8—8 in FIG. 5, showing the pivot in the locked position.
Figure 9:
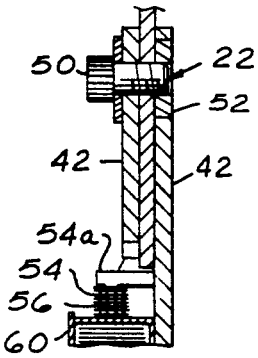
FIG. 9 is a detail partly sectional end view as in FIG. 8, now showing the pivot in the unlocked position.

A preferred structure to pivot and control pivoting of the golf swing brace 10 will be detailed with reference now being made with regard to FIGS. 5 through 10. The upper end 40 of the forearm brace component 16 is formed as a clevis 42, with a slot 44 being provided between each arm of the clevis. The lower end 46 of the upper arm brace component 14 is formed as an abutment member 48, having a peripheral portion 48*a* of circular shape and an abutment 48*b*. The abutment member 48 fits within the slot 44 of the clevis 42. The pivot 22 is composed of a pivot bolt 50 which is inserted into aligned apertures in the clevis and the abutment member, and which is secured by threadable engagement with a nut 52. Thusly, the upper arm brace component 14 is pivotable with respect to the forearm brace component 16 at the pivot 22, the abutment member 48 being pivotable with respect to the clevis 42. A stop pin 54 is slidably connected to the forearm brace component 16 adjacent the clevis 42, and is biased toward the upper end 40 by a spring 56. The stop pin is provided with a head 54*a*. When the stop pin 54 is biased outwardly by the spring 56, the head 54*a* will interferingly engage the abutment 48*b*, as shown in FIG. 5. In this configuration, the pivot 22 is locked so that pivoting is not possible in the direction that the golfer's elbow can bend. But, when the stop pin is caused to be slidably retracted against the biasing of the spring, the head will not interferingly engage the abutment, but will slidably engage the peripheral portion 48*a*, as shown in FIG. 7. In this configuration, pivot 22 is unlocked so that pivoting is freely possible in the direction that the golfer's elbow can bend. A cut-out 58 in the clevis accommodates movement of the head of the stop pin.

Figure 10:
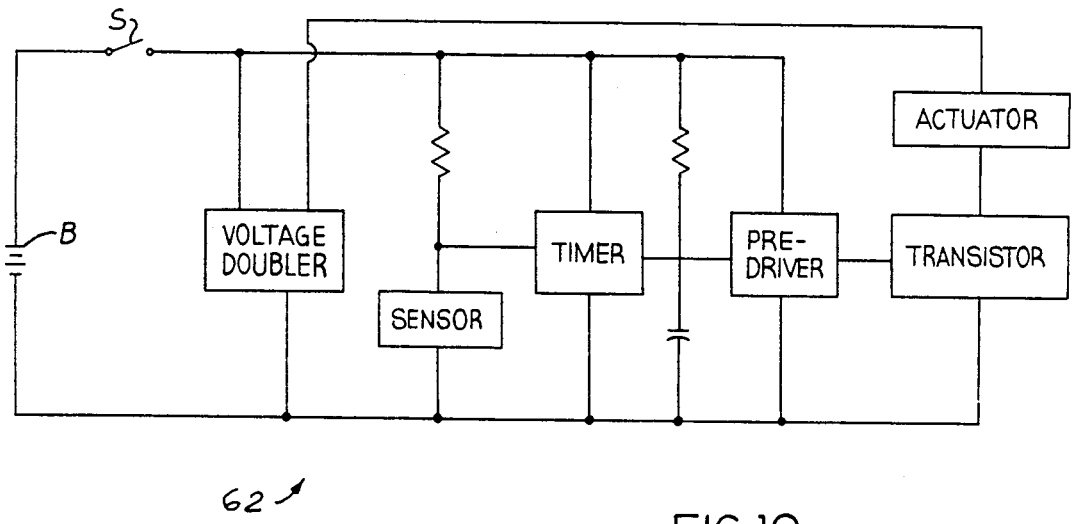
FIG. 10 is an electrical apparatus circuit schematic for the sensor and actuator according to the present invention.

Now attention shall be drawn to a preferred mechanism to cause the pivot pin to slide at a predetermined point in the golf swing so as to unlock the pivot 22 upon addressment of the golf ball. Slidable movement of the stop pin is effected by an actuator 60 in the form of a solenoid with an internally sliding armature. The actuator 60 is connected to the forearm brace component 16 and the stop pin is connected to and rides on the armature of the actuator. A circuit schematic for a preferred electrical apparatus 62 to effect actuation of the actuator 60 is shown in FIG. 10. A battery B supplies power to the circuit upon closure of a switch S. The "Voltage Doubler" takes the battery voltage (nominally 9.5 volts) and doubles it (to 19 volts) so as to provide greater electrical energy at the "Actuator". A "Sensor" in the form of a single pole, single throw inertial switch is nominally open when the golf swing brace 10 is at rest or during the backswing. During the swing, the inertial force generated by the swing causes the "Sensor" to close momentarily, sending a trigger signal to the "Timer" block. The "Timer" block accepts the trigger signal and creates a timing pulse of approximately one second. To effect this timing pulse it is preferred to use a capacitor (C) and a resistor (R) to act in unison, where $\text{time} = 1.1 \times R \times C$. The timing pulse drives the "Pre-Driver". The "Pre-Driver" provides a boost pulse to the output "Transistor". This boost pulse assures that the "Transistor" will turn fully on. The "Transistor" is an electronic switch that allows current from the "Voltage Doubler" to pass through the "Actuator" upon command from the "Sensor". The "Actuator" is a solenoid with an internal slidable armature, the energization of which draws in the armature, causing the stop pin to slide and the pivot to become unlocked.

In operation, the golfer places the arm cradles against his or her lead arm so that the upper arm brace component is oriented parallel with his or her upper arm and the forearm brace component is oriented parallel with his or her forearm, and further positions the pivot to be axially aligned with his or her elbow; in this position, to bend his or her elbow, the pivot must be unlocked. Next, the golfer wraps the arm bands around the arm cradles and his or her arm, threads each arm band through its respective ring, then pulls the arm bands tight and secures each via its hook and loop fastener. The lead arm of the golfer will now be held straight because the pivot is locked by the head on the stop pin being nominally biased by the spring so as to interferingly engage the abutment of the abutment member.

After the golfer has attained the stance shown in FIG. 1, the golfer begins the swing. Inertial forces generated by the swing (FIG. 2) trigger the circuit apparatus to actuate the actuator to produce a force on the stop pin in a direction opposite to and larger than that produced by the spring. Frictional contact between the abutment and the head of the stop pin caused by the tendency of the golfer's arm to bend at the elbow, prevents the stop pin from sliding in response to the force of the actuator. The timer permits the actuator to continue the force for sufficient time for the swing to reach beyond point of addressment of the golf ball. At the point of adressment (FIG. 3), the golfer's arm naturally straightens, and the pinching force of the head on the abutment is thereupon lessened sufficient for the stop pin to slide. The actuator then causes the stop pin to slide and the head moves to a position out of the way of the abutment. Now, the elbow of the golfer is totally free to bend in a completely natural manner as if no brace were present. The swing continues (concluding with FIG. 4) during which the actuator is turned off automatically by the timing circuit, the head then riding along the peripheral portion of the abutment member.

While an inertial sensor, actuator and associated circuit apparatus therefor have been presented herein, it is to be understood by those skilled in the art that this embodiment is presented herein by way of example, and that other possible sensors, actuators and electrical circuits may be substituted using ordinary skill in the art. Consequently, such substitutions are within the contemplation of the present invention. Also, it is to be understood to those skilled in the art that the stop pin and the abutment member can be associated with either of the brace components.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A brace for training a golfer proper golf swing technique of a golf club with respect to a golf ball, said brace being connectable to the lead arm of the golfer, said brace comprising:

a forearm brace component, said forearm brace component being structured to extend a substantial length along of the golfer's forearm;

forearm attachment means for connecting said forearm brace component to the forearm of the golfer;

an upper arm brace component, said upper arm brace component being structured to extend a substantial length along the golfer's upper arm;

upper arm attachment means for connecting said upper arm brace component to the upper arm of the golfer;

pivot means connected with said forearm brace component and said upper arm brace component for pivotally connecting said forearm brace component with respect to said upper arm brace component; and pivot control means connected with said pivot means for selectively locking and unlocking pivotability of said pivot means at predetermined portions of the golf swing;

wherein the golfer attaches said upper arm brace component to and parallel with the upper arm of the lead arm and attaches said forearm brace component to and parallel with the forearm of the lead arm, pivoting of said upper arm brace component with respect to said forearm brace component at said pivot means being axially aligned with the elbow of the lead arm, the golfer thereupon being unable to bend the elbow when said pivot control means locks said pivot means, and the golfer being able to bend the elbow when the pivot control means unlocks said pivot means.

2. The brace of claim 1, wherein said pivot control means comprises:

sensor means for sensing at least one predetermined physical parameter associated with execution of a swing; and actuator means for selectively locking and unlocking said pivot means in response to said sensor means sensing said at least one predetermined physical parameter.

3. The brace of claim 2, wherein said actuator means locks said pivot means during the golf swing until the golf ball has been addressed by the golf club, at which point said actuator means unlocks said pivot means during the remainder of the golf swing.

4. The brace of claim 3, wherein said pivot control means further comprises:

stop pin means connected with said actuator, said actuator being connected with one of said forearm brace component and said upper arm brace component;

abutment means connected with the other of said forearm brace component and said upper arm component;

biasing means for nominally biasing said stop pin means into interfering engagement with said abutment means, said interfering engagement effecting to lock said pivoting means; and electrical apparatus means for actuating said actuator so as to move said stop pin means out of interfering engagement with said abutment means to thereby unlock said pivot means.

5. The brace of claim 4, wherein said sensor means comprises an inertial switch which is responsive to inertial forces generated during a golf swing.

6. The brace of claim 5, wherein said actuator comprises a solenoid and an armature, wherein actuation of said actuator occurs when said armature slides in response to energization of said solenoid by said electrical apparatus means; and further wherein said stop pin means is connected to said armature.

7. The brace of claim 6, wherein said stop pin means is pinched against said abutment means by the lead arm of the golfer during a golf swing until the golf club addresses the golf ball thereby preventing movement of said stop pin means in relation to said abutment means; further wherein the said electrical apparatus means further comprises timer means for energizing said solenoid a predetermined length of time in order that the stop pin means be released from interfering abutment with said abutment means as soon as said pinching of said stop pin means against said abutment means ceases; said abutment means further comprising periphery means for slidingly engaging said stop pin means after said timer means ceases energizing said solenoid so that said pivot means continues to be free to pivot for the remainder of the golf swing.

8. The brace of claim 3, further comprising:

forearm cradle means connected with said forearm brace component for assisting to hold said forearm brace component parallel with respect to the golfer's forearm; and upper arm cradle means connected with said upper arm brace component for assisting to hold said upper arm brace component parallel with respect to the golfer's upper arm.

9. The brace of claim 8, wherein said forearm cradle means comprises at least one substantially U-shaped forearm cradle member which is structured to wrap around a portion of the forearm of the golfer; and wherein said upper arm cradle means comprises at least one substantially U-shaped upper arm cradle member which is structured to wrap around a portion of the upper arm of the golfer.

10. The brace of claim 9, wherein said forearm attachment means comprises at least one flexible forearm arm band which is structured to wrap around the forearm of the golfer and be selectively held tightly about the forearm; and wherein said upper arm attachment means comprises at least one flexible upper arm arm band which is structured to wrap around the upper arm of the golfer and be selectively held tightly about the upper arm.

11. The brace of claim 10, wherein each forearm arm band wraps about each forearm cradle member when being wrapped about the forearm of the golfer; and wherein each upper arm arm band wraps about each upper arm cradle member when being wrapped about the upper arm of the golfer.

12. The brace of claim 3, wherein said pivot control means further comprises:

stop pin means connected with said actuator, said actuator being connected with one of said forearm brace component and said upper arm brace component;

abutment means connected with the other of said forearm brace component and said upper arm component;

biasing means for nominally biasing said stop pin means into interfering engagement with said abutment means, said interfering engagement effecting to lock said pivoting means; and electrical apparatus means for actuating said actuator so as to move said stop pin means out of interfering engagement with said abutment means to thereby unlock said pivot means.

13. The brace of claim 12, wherein said sensor means comprises an inertial switch which is responsive to inertial forces generated during a golf swing.

14. The brace of claim 13, wherein said actuator comprises a solenoid and an armature, wherein actuation of said actuator occurs when said armature slides in response to energization of said solenoid by said electrical apparatus means; and further wherein said stop pin means is connected to said armature.

15. The brace of claim 14, wherein said stop pin means is pinched against said abutment means by the lead arm of the golfer during a golf swing until the golf club addresses the golf ball thereby preventing movement of said stop pin means in relation to said abutment means; further wherein the said electrical apparatus means further comprises timer means for energizing said solenoid a predetermined length of time in order that the stop pin means be released from interfering abutment with said abutment means as soon as said pinching of said stop pin means against said abutment means ceases; said abutment means further comprising periphery means for slidingly engaging said stop pin means after said timer means ceases energizing said solenoid so that said pivot means continues to be free to pivot for the remainder of the golf swing.

16. A brace for training a golfer proper golf swing technique of a golf club with respect to a golf ball, said brace being connectable to the lead arm of the golfer, said brace comprising:

a forearm brace component, said forearm brace component being structured to extend a substantial length along of the golfer's forearm;

forearm attachment means for connecting said forearm brace component to the forearm of the golfer;

an upper arm brace component, said upper arm brace component being structured to extend a substantial length along the golfer's upper arm;

upper arm attachment means for connecting said upper arm brace component to the upper arm of the golfer;

pivot means connected with said forearm brace component and said upper arm brace component for pivotally connecting said forearm brace component with respect to said upper arm brace component; and pivot control means connected with said pivot means for selectively locking and unlocking pivotability of said pivot means at predetermined portions of the golf swing, said pivot control means comprising:

sensor means for sensing at least one predetermined physical parameter associated with execution of a golf swing; and actuator means for selectively locking and unlocking said pivot means in response to said sensor means sensing said at least one predetermined physical parameter;

wherein the golfer attaches said upper arm brace component to and parallel with the upper arm of the lead arm and attaches said forearm brace component to and parallel with the forearm of the lead arm, pivoting of said upper arm brace component with respect to said forearm brace component at said pivot means being axially aligned with the elbow of the lead arm, the golfer thereupon being unable to bend the elbow when said pivot control means locks said pivot means, and the golfer being able to bend the elbow when the pivot control means unlocks said pivot means, said actuator means locking said pivot means during the golf swing until the golf ball has been addressed by the golf club, at which point said actuator means unlocks said pivot means during the remainder of the golf swing.

17. The brace of claim 16, further comprising:

forearm cradle means connected with said forearm brace component for assisting to hold said forearm brace component parallel with respect to the golfer's forearm; and upper arm cradle means connected with said upper arm brace component for assisting to hold said upper arm brace component parallel with respect to the golfer's upper arm.

18. The brace of claim 17, wherein said pivot control means further comprises:

stop pin means connected with said actuator, said actuator being connected with one of said forearm brace component and said upper arm brace component;

abutment means connected with the other of said forearm brace component and said upper arm component;

biasing means for nominally biasing said stop pin means into interfering engagement with said abutment means, said interfering engagement effecting to lock said pivoting means; and electrical apparatus means for actuating said actuator so as to move said stop pin means out of interfering engagement with said abutment means to thereby unlock said pivot means.

19. The brace of claim 18, wherein said sensor means comprises an inertial switch which is responsive to inertial forces generated during a golf swing; further wherein said actuator comprises a solenoid and an armature, wherein actuation of said actuator occurs when said armature slides in response to energization of said solenoid by said electrical apparatus means; and further wherein said stop pin means is connected to said armature.

20. The brace of claim 19, wherein said stop pin means is pinched against said abutment means by the lead arm of the golfer during a golf swing until the golf club addresses the golf ball thereby preventing movement of said stop pin means in relation to said abutment means; further wherein the said electrical apparatus means further comprises timer means for energizing said solenoid a predetermined length of time in order that the stop pin means be released from interfering abutment with said abutment means as soon as said pinching of said stop pin means against said abutment means ceases; said abutment means further comprising periphery means for slidingly engaging said stop pin means after said timer means ceases energizing said solenoid so that said pivot means continues to be free to pivot for the remainder of the golf swing.

* * * * *